US009669255B2

(12) United States Patent
Henniger

(10) Patent No.: US 9,669,255 B2
(45) Date of Patent: Jun. 6, 2017

(54) GLUTE HAM DEVELOPER

(71) Applicant: Coulter Ventures, LLC, Columbus, OH (US)

(72) Inventor: William Henniger, Columbus, OH (US)

(73) Assignee: Coulter Ventures, LLC, Columbus, OH (US)

( * ) Notice: Subject to any disclaimer, the term of this patent is extended or adjusted under 35 U.S.C. 154(b) by 0 days.

(21) Appl. No.: 14/722,028

(22) Filed: May 26, 2015

(65) Prior Publication Data

US 2016/0045780 A1 Feb. 18, 2016

Related U.S. Application Data

(60) Provisional application No. 62/002,440, filed on May 23, 2014.

(51) Int. Cl.
*A63B 26/00* (2006.01)
*A63B 21/00* (2006.01)
(Continued)

(52) U.S. Cl.
CPC .... *A63B 21/4039* (2015.10); *A63B 21/00047* (2013.01); *A63B 21/4013* (2015.10);
(Continued)

(58) Field of Classification Search
CPC ..... A63B 21/00047; A63B 21/065; A63B 21/068; A63B 21/16; A63B 21/1609; A63B 21/1672; A63B 21/1681; A63B 21/169; A63B 21/4011; A63B 21/4013; A63B 21/4015; A63B 21/4023; A63B 21/4025; A63B 21/4027; A63B 21/4029;
(Continued)

(56) References Cited

U.S. PATENT DOCUMENTS 3,134,592 A * 5/1964 Sharkey ..... A63B 23/0211 482/140
3,567,218 A * 3/1971 Johnson ..... A63B 23/0233 482/140
(Continued)

OTHER PUBLICATIONS

Printout of Picture from http://board.crossfit.com/showthread.php?t=48018 dated Jun. 23, 2009.
(Continued)

*Primary Examiner* — Loan H Thanh
*Assistant Examiner* — Gary D Urbiel Goldner
(74) *Attorney, Agent, or Firm* — The Watson I.P. Group, PLC; Jovan N. Jovanovic; Vladan M. Vasiljevic

(57) ABSTRACT

A glute ham developer comprising a pad assembly and a foot retention assembly. The pad assembly includes a retention sub-assembly coupling a base pad portion to an existing box. The foot retention assembly including a base plate having a foot surface and a support surface. A mating channel extends from the support surface of the base plate. The mating channel is releasably coupled to an existing outside support spaced apart from the existing box. A roller assembly extends from the foot surface of the base plate. The roller assembly has a pair of roller axles in a spaced apart orientation relative to each other defining a foot receiving region therebetween.

20 Claims, 11 Drawing Sheets

(51) Int. Cl.
*A63B 23/02* (2006.01)
*A63B 23/04* (2006.01)

(52) U.S. Cl.
CPC ..... *A63B 21/4015* (2015.10); *A63B 21/4029* (2015.10); *A63B 23/0211* (2013.01); *A63B 23/0222* (2013.01); *A63B 23/0233* (2013.01); *A63B 23/04* (2013.01); *A63B 2208/0252* (2013.01); *A63B 2225/093* (2013.01)

(58) Field of Classification Search
CPC ..... A63B 21/4034; A63B 21/4037; A63B 21/4039; A63B 23/0211; A63B 23/0222; A63B 23/0233; A63B 23/04; A63B 23/0405; A63B 23/0482; A63B 69/0057; A63B 69/0059; A63B 2069/0062; A63B 2208/0238; A63B 2208/0252; A63B 2208/0285; A63B 2225/09; A63B 2225/093
See application file for complete search history.

(56) References Cited

U.S. PATENT DOCUMENTS 3,682,475 A * 8/1972 Walker ..... A63B 23/0233 482/140
4,116,434 A * 9/1978 Bernstein ..... A63B 21/1645 482/140
4,185,816 A * 1/1980 Bernstein ..... A63B 21/1645 482/140
4,210,322 A * 7/1980 Pritchard ..... A63B 21/00047 446/216
4,398,713 A * 8/1983 Ellis ..... A63B 23/0211 482/145
4,515,361 A * 5/1985 Melillo ..... A63B 23/0211 482/140
4,542,900 A * 9/1985 Ray ..... A63B 23/0494 482/101
4,669,724 A * 6/1987 Matheisen ..... A61H 1/0218 482/145
4,679,788 A * 7/1987 Adler ..... A63B 21/0615 482/108
4,848,740 A * 7/1989 VanDerHoeven ... A63B 21/154 482/103
4,884,804 A * 12/1989 Fenwick ..... A63B 23/0211 482/140
5,106,083 A * 4/1992 Hall ..... A63B 21/00047 482/141
5,135,459 A * 8/1992 Perry, Jr. ..... A63B 21/00047 482/144
5,263,919 A * 11/1993 Hollenback ..... A63B 21/00047 482/142
5,433,220 A * 7/1995 Kostich ..... A61B 6/0421 5/622
D369,841 S * 5/1996 Yang ..... D21/687
5,584,786 A * 12/1996 Almeda ..... A63B 21/00047 482/140
5,623,949 A * 4/1997 Kostich ..... A61B 6/0421 128/845
5,935,050 A * 8/1999 Shahan ..... A63B 23/0211 482/140
6,030,325 A * 2/2000 Ottoson ..... A61H 1/0218 482/144
6,231,487 B1 * 5/2001 Diamond, Jr. ..... A63B 21/026 482/121
6,254,517 B1 * 7/2001 Kennedy ..... A63B 21/04 482/121
6,468,188 B1 * 10/2002 Koenig ..... A63B 21/0615 482/137
6,692,418 B2 * 2/2004 Shahan ..... A63B 23/02 482/143
7,172,540 B2 * 2/2007 Nguyen ..... A63B 21/1672 482/140
7,384,383 B2 * 6/2008 Forcillo ..... A63B 21/0615 482/140
7,637,851 B1 * 12/2009 Lormil ..... A63B 23/12 482/141
D613,804 S * 4/2010 Perez ..... D21/691
7,691,042 B2 * 4/2010 Pandozy ..... A63B 23/0211 482/142
8,007,414 B2 * 8/2011 Riney ..... A63B 21/0615 482/137
D685,867 S * 7/2013 Mehlman ..... D21/687
8,491,450 B2 * 7/2013 Perry, Jr. ..... A61H 1/0218 482/142
8,632,445 B2 * 1/2014 Kim ..... A63B 21/4035 482/140
9,119,984 B2 * 9/2015 Littell ..... A63B 26/00
9,192,801 B1 * 11/2015 Gouloubev ..... A63B 21/00047
9,259,604 B2 * 2/2016 Miller, Jr. ..... A63B 21/068
2001/0034289 A1 * 10/2001 Parrillo ..... A63B 23/035 482/94
2002/0119872 A1 * 8/2002 Greenheck ..... A63B 21/072 482/93
2005/0107225 A1 * 5/2005 Diamond ..... A63B 21/4025 482/105
2005/0159279 A1 * 7/2005 Stangler ..... A63B 21/00047 482/148
2006/0116262 A1 * 6/2006 Pandozy ..... A63B 23/0211 482/142
2007/0072749 A1 * 3/2007 Lay ..... A63B 21/06 482/94
2007/0197360 A1 * 8/2007 Rester ..... A61H 1/02 482/23
2007/0298948 A1 * 12/2007 Chen ..... A61H 1/0218 482/144
2008/0051273 A1 * 2/2008 Storch ..... A63B 21/00047 482/141
2008/0096744 A1 * 4/2008 Perry, Jr. ..... A61H 1/0218 482/144
2009/0264265 A1 * 10/2009 Contreras ..... A63B 21/00047 482/99
2012/0208682 A1 * 8/2012 Kueckelhan ..... A63B 23/0211 482/131
2012/0295780 A1 * 11/2012 Chou ..... A63B 23/12 482/142
2014/0066276 A1 * 3/2014 Hornback ..... A63B 21/068 482/145

OTHER PUBLICATIONS

Printout of Picture from http://board.crossfit.com/showthread.php?p=896987 dated Jan. 27, 2011.
Printout of Video still image from https://www.youtube.com/watch?v=C4s1YmCZfe4 dated Jan. 13, 2013.
Printout of Picture from http://ironstrong.org/topic/671-project-ii-home-build-ghr-machine/ dated Nov. 14, 2011.
Printout of Picture from http://board.crossfit.com/showthread.php?t=77247 dated Aug. 16, 2012.
Printout from Blog site http://diystrengthgear.blogspot.co.uk/2009/08/home-made-glute-ham-raise.html dated Aug. 6, 2009.
Printout of Video still image from https://www.youtube.com/watch?v=z15C9UZUbss dated Apr. 30, 2013.

* cited by examiner

GLUTE HAM DEVELOPER

CROSS-REFERENCE TO RELATED APPLICATION

This application claims priority from U.S. Provisional Patent Application Ser. No. 62/002,440, filed May 23, 2014, entitled "Rack-Mounted Glute-Ham Developer And Method For Making The Same", the entire specification of which is hereby incorporated by reference in its entirety.

BACKGROUND OF THE DISCLOSURE

1. Field of the Disclosure

The disclosure relates in general to exercise equipment, and more particularly, to a glute ham developer which can be mounted to existing equipment, such as existing outside supports and existing boxes or other structures for ease of assembly and disassembly.

2. Background Art

The use of exercise equipment in the form of a glute ham developer is known in the art. Typically, a glute ham developer is a stand-alone piece of exercise equipment that includes a relatively large frame. A foot plate is coupled to the frame, as is a positioning surface or pad. The two may be adjustable relative to the frame and relative to each other. Among other glute ham developers, one such glute ham developer is available from Rogue Fitness of Columbus, Ohio as model ROGUE ABRAM GHD™, ROGUE MONSTER SWING ARM GHD™ and SORINEX GHD™. Of course, other such glute ham developers are available from other manufacturers.

To utilize such a device, in an exercise known as the glute ham raise, an athlete may initially lie face down with the upper legs against the pad with the feet secured in between rollers of the foot plate. The upper body may be brought from a resting, or downwardly angled position, in an upward direction to a horizontal position (known as the "super man position") and ultimately to an upward vertical position. Such a movement will exercise a number of different muscles, including, but not limited to spinal erectors, gluteal muscles and the hamstring muscles.

The known glute ham developers have been successful exercise equipment and have formed a foundation piece in a number of different exercise disciplines (i.e., CROSSFIT®). However, many of the existing glute ham developers have drawbacks. For example, the known glute ham devices tend to be relatively expensive stand alone devices. Additionally, known glute ham devices tend to include a relatively large frame which occupies a substantial amount of space, which for many gyms and home gyms is scarce or unavailable.

Other solutions are cobbled together by a user from other equipment (i.e., medicine balls, floor mats, pipes, rollers, etc.) to form a device that will allow for similar exercises to those performed on a glute ham device. However, such devices often lack the structure necessary for repetitive execution of such exercises. Additionally, such devices are often unstable making them incapable of supporting exercise and also leading to injuries. Finally, such devices often lack the ability to easily adjust to other users, or to couple to other outside structures for support and transportability.

SUMMARY OF THE DISCLOSURE

In an aspect of the disclosure, the disclosure is directed to a glute ham developer comprising a pad assembly and a foot retention assembly. The pad assembly includes a retention sub-assembly coupling the base pad portion to an existing box. The foot retention assembly includes a base plate having a foot surface and a support surface. A mating channel extends from the support surface. The mating channel is releasably coupled to an existing outside support spaced apart from an existing box. A roller assembly extends from the foot surface of the base plate. The roller assembly has a pair of roller axles in a spaced apart orientation relative to each other defining a foot receiving region therebetween.

In some configurations, the glute ham developer further includes a stabilizer assembly having a first end coupled to an existing box and a second end attachable to an existing outside support.

In some such configurations, the stabilizer assembly further includes a box coupling bracket coupled to an existing box, and a beam portion. The beam portion is pivotably coupled to the box coupling bracket about a first pivot axle, with the beam portion selectively attachable to an existing outside support.

In some configurations, the box coupling bracket further includes a top engaging panel positionable to overlie a top wall of an existing box, a first and second dependent leg extending therefrom and across a front wall of an existing box. The first and second dependent legs having a corresponding opening to receive the first pivot axle. The beam portion includes a first side portion interfaceable with the first dependent leg. A second side portion is interfaceable with the second dependent leg. Each of the side portions having a pivot opening to receive the first pivot axle, to, in turn, allow for the top beam portion to pivot about the first pivot axle relative to the box coupling bracket.

In some configurations, the first side portion and the second side portion further include corresponding openings spaced apart from the pivot opening. The corresponding openings are configured to receive a rack coupling pin through each of the first side portion and the second side portion, and structurally configured to receive an existing outside support therebetween.

In some configurations, each of the first side portion and the second side portion include a plurality of pairs of corresponding openings. Such a configuration, in turn, provides a plurality of receiving openings for the rack coupling pin.

In some configurations, the beam portion further includes a cross brace that extends between the first side portion and the second side portion. Such a configuration couples the first and second side portions.

In some configurations, the pad assembly further comprises a base pad portion that has a bottom surface and a top surface. The bottom surface has a grip insert portion formed from a material of high friction.

In some configurations, the pad assembly further comprises a base pad portion having a top surface, and a raised pad portion. The raised pad portion extends from the top surface of the base pad portion. The raised portion includes an outwardly convex configuration. In some configurations, the raised pad portion includes a first portion and a second portion spaced apart from the first portion. The first and second portion are mirror images of each other taken about an axis midway between opposing side edges of the base pad portion.

In some configurations, the retention subassembly further comprises at least one side strap that is configurable to extend about an existing box. As such, the side strap, releasably secures the pad assembly to the existing box.

In some configurations, at least one side strap further comprises at least two side straps positioned in a side by side spaced apart configuration.

In some configurations, the at least two side straps extend from a front of the pad assembly around a front wall, a back wall and a bottom of an existing box to the back of the pad assembly.

In some configurations, each of the at least two side straps include a length. The length of each of the at least two side straps are adjustable.

In some configurations, each of the at least two side straps include a first member and a second member. The first and second members are coupled through a clasp portion.

In some configurations, the mating channel further includes a first side panel and a second side panel. The first and second side panels including at least one set of corresponding openings, alignable with openings on an existing outside support. The coupling member is extendable through openings on an existing outside support and the plurality of corresponding openings, to releasably couple the same.

In some configurations, the first and second side panels each include a plurality of sets of corresponding openings.

In some configurations, the mating channel is formed from a bent portion of the base plate, to, in turn, define a pair of openings on either side thereof.

In another aspect of the disclosure, the disclosure is directed to a system having a glute ham developer. The system comprises an existing box, a pad assembly, an existing outside bracket, and a foot retention assembly. The existing box has a top surface. The pad assembly is positionable on the top surface of the existing box. The existing outside bracket is attachable to one of a ground surface and a wall. The foot retention assembly has a base plate and a roller assembly extending from the base plate. The roller assembly is configured to releasably retain the feet of a user. The foot retention assembly further has a mating channel releasably engageable with the existing outside bracket. The existing box is positioned on a ground surface spaced apart from the existing outside bracket.

In some configurations, the system further comprising a stabilizer assembly including a first end coupled to the existing box, and a second end coupled to the existing outside bracket.

In some configurations, the pad assembly includes a retention subassembly. The retention subassembly is structurally configured to releasably couple the pad assembly to the existing box.

In some configurations, the retention subassembly further comprises at least one side strap extending about the existing box.

In some configurations, the existing outside bracket forms part of at least one of the group consisting of, a wall mount bracket, a rig, a rack and a squat stand.

In yet another aspect of the disclosure, the disclosure is directed to a method of assembling a glute ham developer comprising the steps of: (a) providing a pad assembly; (b) positioning the pad assembly on a top surface of an existing box; (c) releasably retaining the pad assembly on the top surface of the existing box; (d) providing a foot retention assembly, the foot retention assembly having a mating channel extending from a support surface of a base plate; (e) extending the mating channel over a portion of an existing outside support; and (f) releasably coupling the mating channel over the existing outside support.

In some configurations, the method further comprises the steps of: (a) providing a stabilizer assembly; (b) coupling a first end of the stabilizer assembly to the existing box; and (c) coupling a second end of the stabilizer assembly to the existing outside support.

BRIEF DESCRIPTION OF THE DRAWINGS

The disclosure will now be described with reference to the drawings wherein.

DETAILED DESCRIPTION OF THE DISCLOSURE

Figure 1:
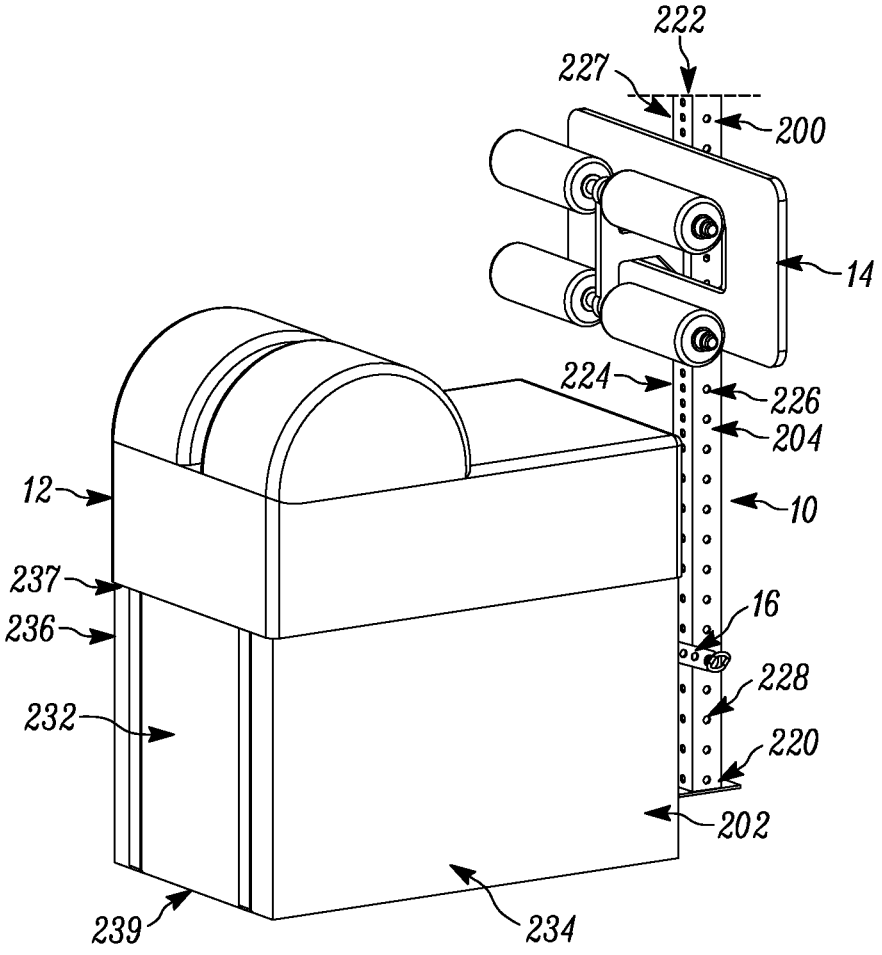
FIG. 1 of the drawings is a perspective view of a configuration of the glute ham developer in a system environment, with the foot retention assembly mounted to an existing outside support and a pad assembly mounted to an existing box.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the glute ham developer is shown generally at 10. The glute ham developer is configured from multiple components that can be coupled together, selectively, and to an existing outside support, such as rack 200, and which can incorporate an existing box (such as a box offered by Rogue Fitness of Columbus, Ohio under the trademark PLYOBOX®) 202 to form a full system. It will be understood that conventionally, such glute ham developers include a frame member and generally occupy a substantial amount of space. Where space is a premium, the glute ham developer of the present disclosure leverages existing structures while minimizing the space necessary for the same, both in use and for storage, while providing the necessary adjustability and stability. The glute ham developer is shown in a system environment and in use in FIGS. 10 and 11.

The existing outside support 200 may comprise, for example, an upright beam of a rack, or a rig which is coupled to the floor of a gym or building. For example, the outside support may comprise a vertical beam of any one of the MONSTER™, MONSTER LITE™, INFINITY™, and ECHO™ series of rigs, wallmounts, racks and squat stands offered by Rogue Fitness of Columbus, Ohio. In other configurations, the outside support may comprise a wall mounted beam, such as, for example, the beam offered by Rogue Fitness of Columbus, Ohio under the trademark THE STRIP®. Of course, these are merely exemplary and other outside supports are likewise contemplated, including, but not limited to those of other manufacturers and suppliers.

Referring again to FIG. 1, the outside support includes a first end 220 and a second end 222, with the second end being spaced apart further from the ground. The support typically comprises a metal stock having a square, rectangular or c-channel shape which includes a front panel 224 and side panels 226, 227. The side panels generally include openings, at least some of which openings correspond or mate between the side panels. The front panel (which in some configurations may become the back panel, as with a channel) may also have openings that include some openings that correspond or mate between themselves. For example, the openings may comprise one half or a ⅝" diameter and they may be spaced apart 2" on center. Of course, this is merely exemplary, and other dimensional considerations are contemplated.

Figure 4:
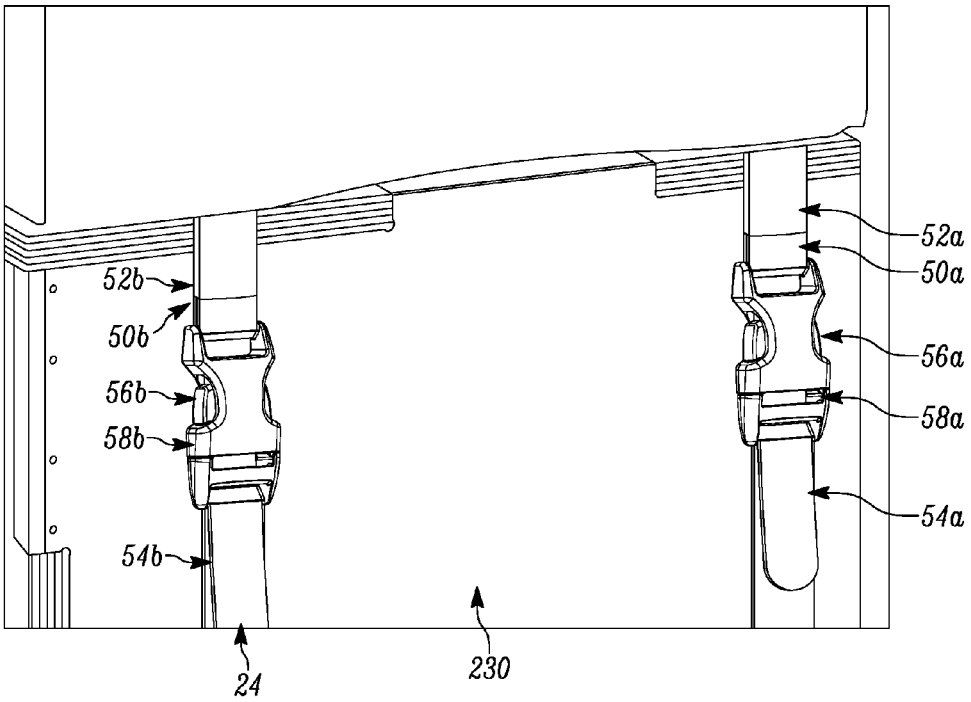
FIG. 4 of the drawings is a partial front perspective of the existing box, showing, in particular, a portion of the pad assembly, with the first and second side straps of the retention subassembly extending about the existing box.
Figure 6:
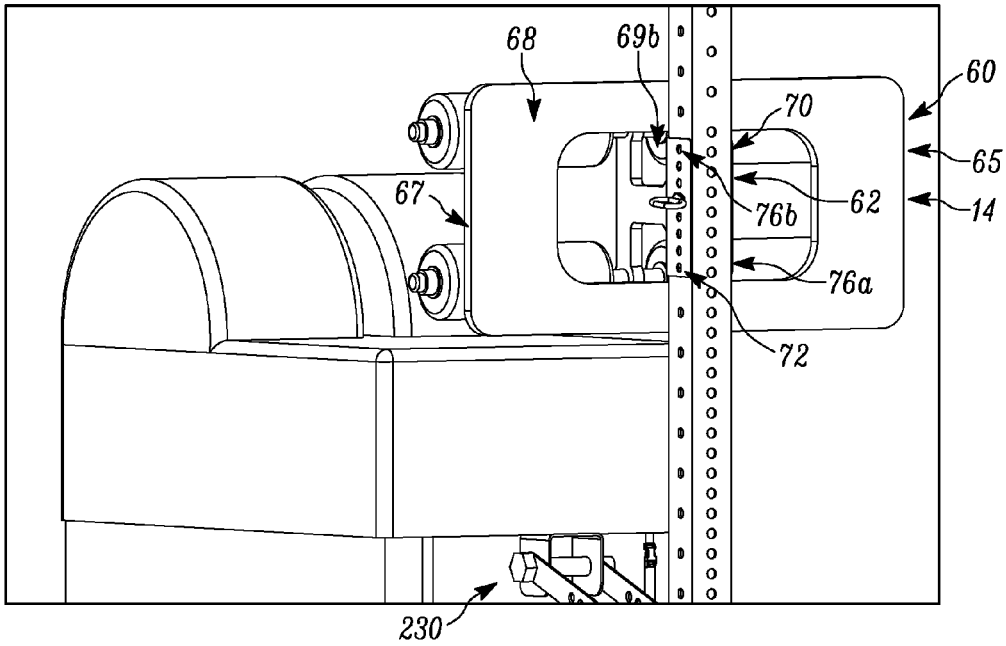
FIG. 6 of the drawings is a partial perspective view of a configuration of the glute ham developer in a system environment, with the foot retention assembly mounted to an existing outside support and the pad assembly mounted to the existing box, with the stabilizer assembly coupling the existing box to the existing outside support, showing, in particular, the coupling of the mating channel of the foot retention assembly with the existing outside support.

Referring now to FIGS. 1, 4, 6 and/or 7, the existing box 202 may comprise a generally rectangular cubic configuration having a front wall 230, back wall 232, first side wall 234, second side wall 236 and top wall 238. In many of the available existing boxes, the bottom wall is omitted, thus providing access to the inner cavity. In other embodiments, a bottom wall may be provided (or the box may be turned on a side, wherein one of the side walls or the front or back wall will define an opening to the inner cavity). The front wall, back wall, first side wall and second side wall cooperate to define upper edge 237 and lower edge 239. The upper edge 237 generally corresponds to the perimeter of the top wall 238.

Such existing boxes may be formed from a plywood material, among other materials. One such existing box is available from Rogue Fitness of Columbus, Ohio under the trademark ROGUE FLAT PACK GAMES BOX™. Of course, the configuration is not limited to such a configuration, or to rectangular cubic boxes. Other configurations include a frame type box formed from steel tubing with a top surface, or foam type boxes that are formed from a generally relatively resilient foam member. In addition, configurations that are other than rectangular or square cubic are contemplated, including but not limited to pyramidal frustum (such as, for example, a truncated square pyramid). Any number of different configurations are contemplated, although, preferably, the top wall generally, is preferred to be a square or rectangular shape (or a shape that generally corresponds to the base pad portion 20 of the pad assembly 12).

Figure 2:
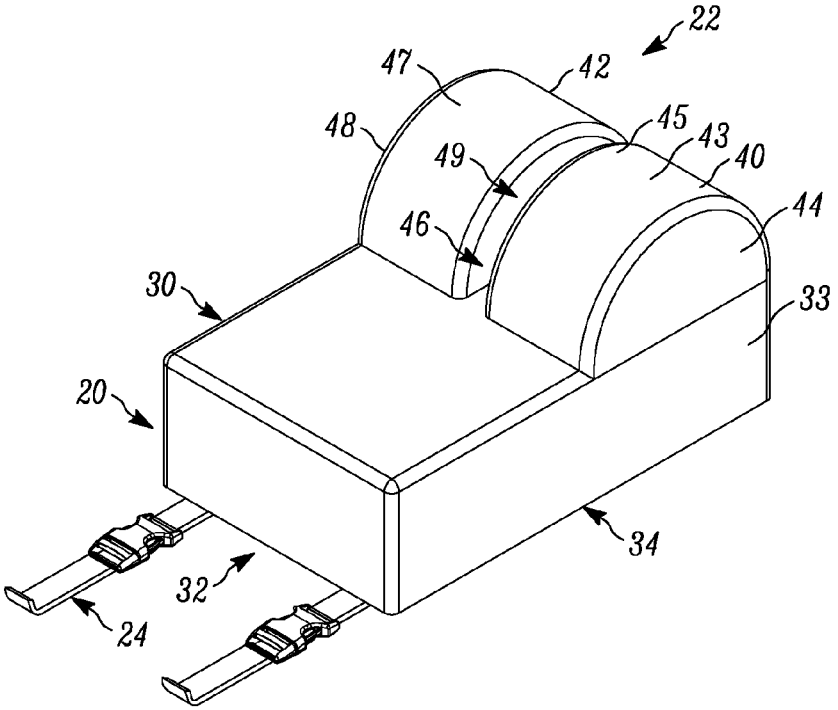
FIG. 2 of the drawings is an exploded view of a configuration of the glute ham developer showing, in particular, the pad assembly and the foot retention assembly.
Figure 2:
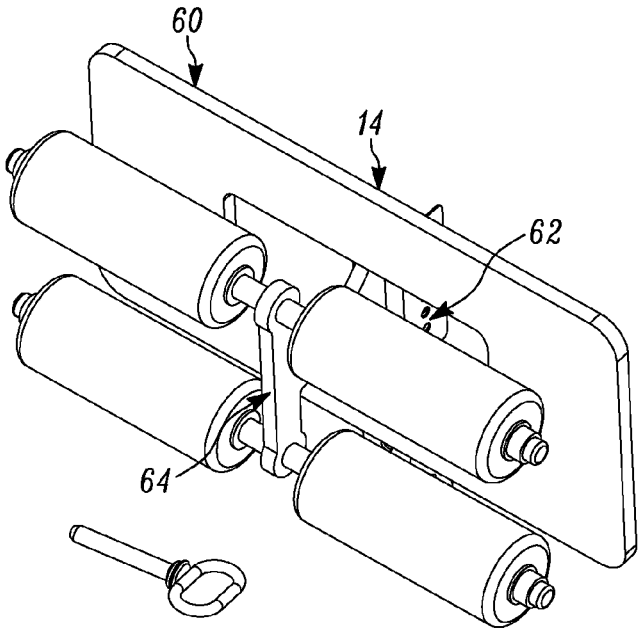
Figure 3:
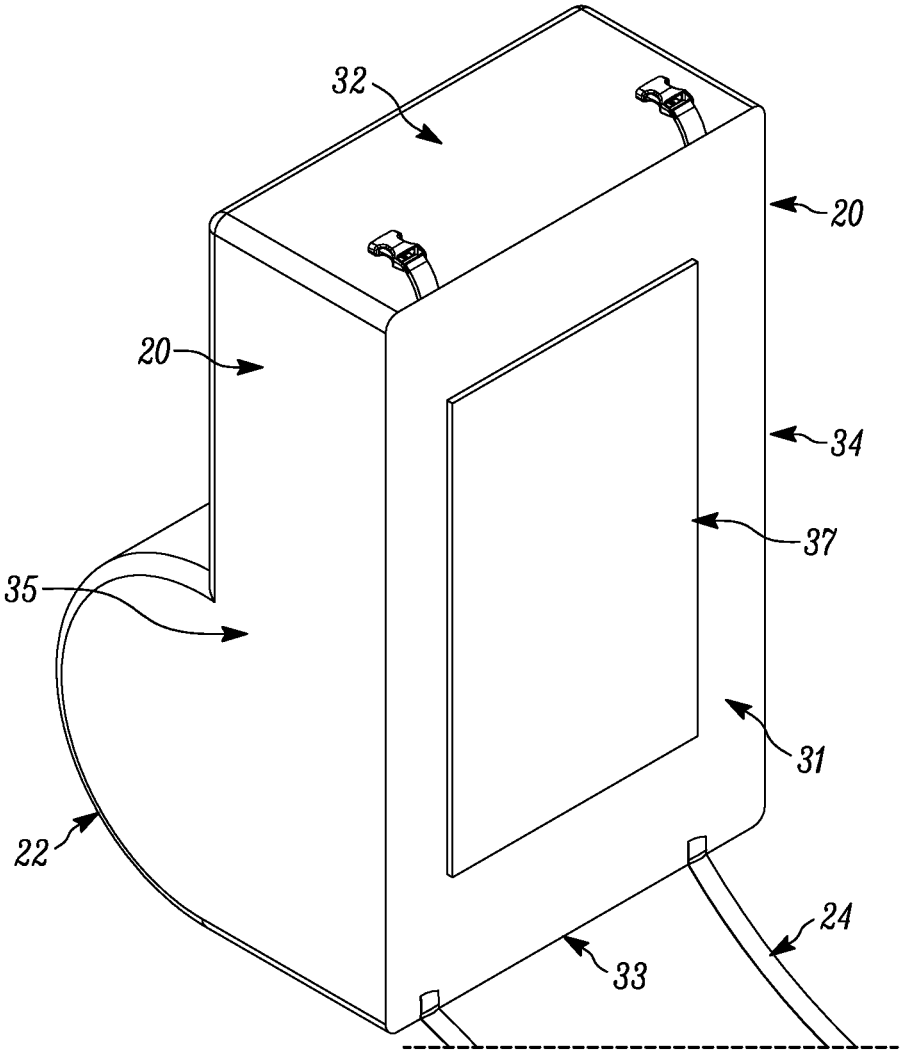
FIG. 3 of the drawings is a bottom perspective view of a configuration of the pad assembly of the glute ham developer.

With reference to FIG. 1, the glute ham developer is shown in the operational environment as comprising pad assembly 12, foot retention assembly 14 and stabilizer assembly 16. FIG. 2 shows the pad assembly and the foot retention assembly in separate form. With reference to FIGS. 1 through 4, the pad assembly 12 includes base pad portion 20, raised pad portion 22 and retention sub-assembly 24. The pad assembly generally comprises a plurality of foam type pads that are covered with a covering (such as vinyl or leather), in a single form or in multiple components. That is, the covering may comprise a single covering that incorporates a number of separate pads (or a single molded pad).

In the configuration shown, the base pad portion comprises a generally rectangular configuration that is substantially uniform in thickness thereacross. The base pad portion includes top surface 30, bottom surface 31, front surface 32, back surface 33, first side surface 34 and second side surface 35. In the configuration shown, the footprint of the base pad generally matches the configuration of the top wall 238 of the existing box. Variations are contemplated, such as larger or smaller pad footprints, as well as a base pad portion with a varying topography that defines a pad member of a non-uniform thickness. The bottom surface 31 includes a grip member which is positioned over a portion of the bottom surface, in the embodiment shown, spaced apart from the side edges thereof. The grip member provides a surface of high friction which aids in the maintaining of the pad assembly in the proper orientation on, for example, the existing box 202.

The raised pad portion 22 includes first portion 40 and second portion 42. The two portions are generally identical in configuration and are positioned in opposing corners of the pad assembly proximate the back 33, in a spaced apart fashion. The first portion 40 includes top surface 43, outside surface 44 and inside surface 45. The top surface comprises an outwardly convex surface that is generally uniform in cross-section between the inside and outside surfaces 44, 45 and which surface has a substantially semi-circular cross-section. Similarly, the second portion 42 includes top surface 47, outside surface 48 and inside surface 49. The top surface 47 is likewise outwardly convex and uniform in cross-section between the inside and outside surfaces 48, 49. The first portion and the second portion define a channel 46 between the inside surfaces 45, 49. In certain configurations, the area between the two may be raised such that the depth of the channel 46 is shorter than the height of the raised portions. In other configurations, the top surface of the base portion defines the channel along with the inside surfaces 45, 49. In still other configurations, the first portion and the second portion may merge into a single generally uniform configuration thereacross. In still other configurations, the first and second portions may be varied in structure, so that they are completely distinct, or so that they are mirror images thereof about an axis taken generally mid-way between the sides, from the front to the back. In still other configurations, the raised pad portions may be modifiable by the user.

It will be understood, and as explained above, the base pad portion and the raised pad portion may be formed from one, two, three or more different members (typically a foam based material). For example, the entire pad assembly may be a single molded urethane foam. In other configurations, the pad assembly may be a cut foam material from a single blank of material. In still other configurations, the pad assembly may be formed from a plurality of formed or cut foam members, i.e., one piece of foam for the base pad portion and one piece of foam for the raised pad portion, or for each of the first and second portions of the raised pad portion. In still other configurations, multiple discrete foam members may be assembled to form the pad assembly. The different members may be adhered together, or may be positioned within the cover member loosely, with the cover member maintaining the relative position of each of the internal pad members. The cover member may be fully sealed (through stitching or heat welds and the like), or may include a selectively accessible opening, which is maintained in the desired open or closed configuration through a fastener, such as a zipper, a hook and loop fastener, snaps, buttons and the like. The cover member may comprise any number of different fabric materials, polymer based webs or woven materials, along with other natural or synthetic members including leather, vinyl and the like. Additionally, it is contemplated that for certain configurations, a pad assembly having a uniform pad may be provided, that is, a pad that is substantially of a uniform thickness or that does not include the raised pad portions.

With particular reference to FIG. 4, the retention sub-assembly may comprise a first side strap 50*a* and a second side strap 50*b*. It will be understood that while two straps are shown that are spaced apart from each other, other embodiments may rely on a single strap or straps in excess of three. In other configurations, the retention sub-assembly may comprise a plurality of hook and loop fasteners that attach to each other or to the existing box directly. The first side strap 50*a* includes first member 52*a*, and second member 54*a*. The first member 52*a* extends from the front 32 of the base pad portion 20 spaced a predetermined distance from the first side 34 (generally proximate the interface between the front and the bottom surface 31). The second member 54*a* is generally spaced apart from the first side 34 the same predetermined distance as the first member, and extends from the back of the base pad portion 30 generally proximate the interface between the front and the bottom surface 31.

At the end of the first member is a first clamp portion 56*a*, and at the end of the second member is a second clamp portion 58*a*. The two clamp portions matingly engage with each other in a releasable manner. Such clamps or clips are well known in the art. It will also be understood that the relative length of one or both of the first and second members can be controlled by movement of the respective clamp portion along the respective first and second member. Of course, other types of clamps are contemplated such as hook and loop fasteners, snaps, double ring mechanisms, among others, with the side strap being substantially inelastic or having some elasticity. Such structures allow for the adjustment of the effective length of the first side strap so that the same can be tightly positioned around the existing box 202.

Similarly, the second strap has a configuration that substantially preferably operationally matches the first side strap. The second side strap 50*b* includes first member 52*b* and second member 54*b*. The first member 52*b* extends from the front 32 of the base pad portion 20 spaced a predetermined distance from the second side 35 of the base pad portion proximate the interface between the front and bottom surface. The second member 54*b* is generally spaced apart from the second side 35 the same predetermined distance as the first member, and extends from the back of the base pad portion generally proximate the interface between the front and the bottom surface.

A similar clamp portion 56*b* and 58*b* are utilized, with the clamp portion 56*b* being coupled to the first member 52*b* and the clamp portion 58*b* being coupled to the second member 54*b*. The two clamp members are releasably coupled to each other.

The first members 52*a*, 52*b* are generally shorter than the second members 54*a*, 54*b* such that the adjustment and the fastening of the clamps occurs toward the upper edge 37 of the existing box 202. Of course, by varying the length of the respective members of the straps, the location of clamping can be varied so as to be proximate the front wall or the back wall as desired. In other configurations, the adjustment may be positioned so that the clamp member is captured along the bottom of the existing box, and so that it is captured by the cavity defined by the existing box. Advantageously, however, it is desired that the adjustment occur proximate the upper edge, and that adjustment is achieved by directing an end of the strap in a downward direction. Such an adjustment allows for a quick connection, adjustment and disconnection, and further allows for minimal detaching in the event that access to the stabilizer assembly 16 becomes necessary.

Figure 5:
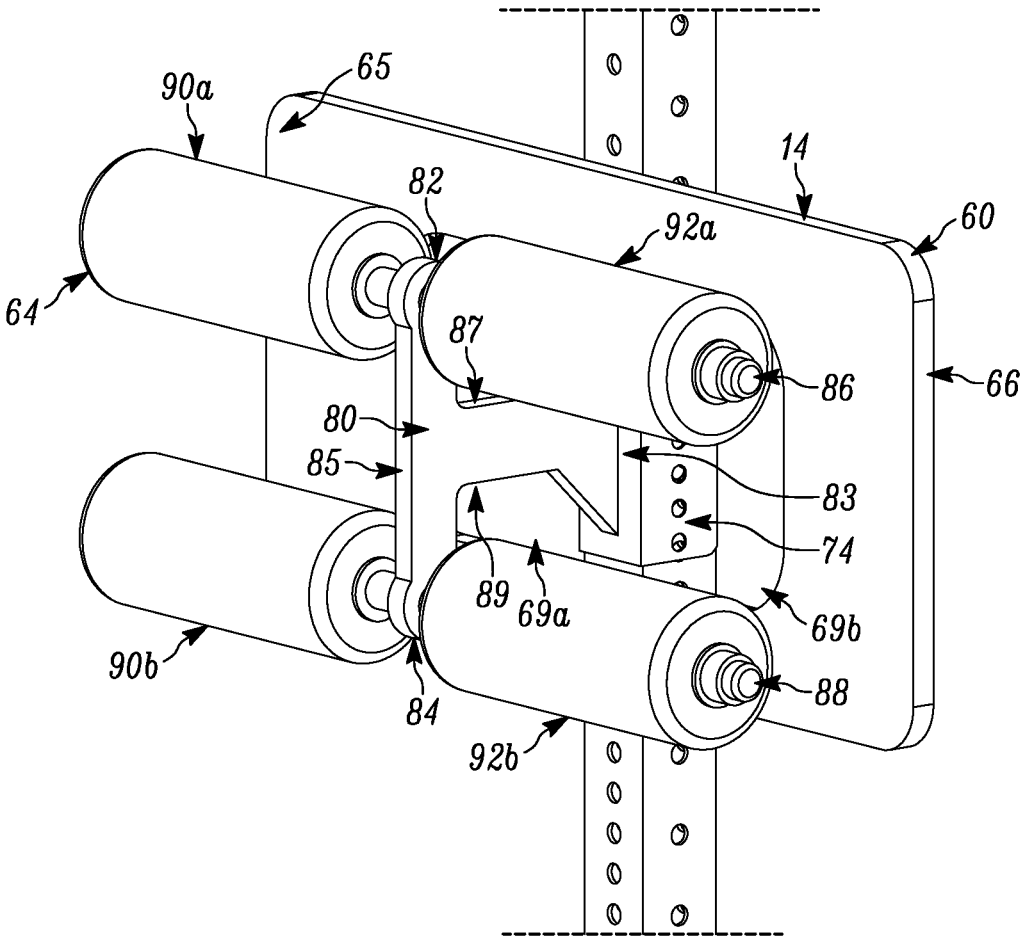
FIG. 5 of the drawings is a perspective view of the foot retention assembly of the glute ham developer of the present disclosure, showing, in particular, the coupling thereof to an existing outside support, which comprises a generally square cross-sectional configuration having a plurality of holes in a spaced apart fashion.

The foot retention assembly 14 is shown in FIGS. 2, 5, 6 and/or 9, as comprising base plate 60, mating channel 62 and roller assembly 64. The base plate 60 generally comprises a planar member having a substantially uniform thickness defining a foot surface 66 and a support surface 68, as well as side edges 65, 67. In the embodiment shown, the mating channel 62 is formed by cutting and bending a portion of the base plate, thereby defining openings 69*a*, 69*b* in the base plate. The openings provide additional visibility on the opposing side of the base plate (and, for example, to the pin coupling the structures).

The mating channel extends generally vertically along the support surface generally bisecting the base plate between the side edges 65, 67. The mating channel includes first side panel 70, second side panel 72 and base portion 74. In the embodiment shown, the base portion is formed from the support surface 68 of the base plate, with the first side and second side panels comprising folded portions of the base plate. The two side panels are substantially parallel to each other and substantially perpendicular to the base portion so as to define a c-channel. The c-channel generally corresponds to one of the panels of the outside support 200. For example, the width of the c-channel matches, in the embodiment shown, the front panel 224 so that the front panel can fit therewithin. It will be understood that the fit between the components is such that the desired amount of force is necessary to couple the two structures. For example, it may be desirable to have an interference fit between the two structures, or even a fit where one of the surfaces is biased against the other. On the other hand, a relatively spaced apart loose connection between the components is likewise contemplated.

The first side panel 70 and the second side panel 72 each include a plurality of openings 76*a*, 76*b*, respectively, with at least some of the openings being positioned in a corresponding fashion, and with at least some of the openings corresponding to the openings 228 of the side panels 226, 227 (wherein the base portion 74 overlies a front panel 224), thereby forming corresponding pairs.

It will be understood that in the configuration shown, the mating channel 62 is formed from portions of the base plate. This has multiple advantages. First, the components are formed from a single member. Second, the openings 69*a*, 69*b* are defined by the bending of the first and second side panels, allowing for a visual identification of the pin member retaining the foot retention assembly to the existing outside support. Third, a certain measure of rigidity is provided to the underlying base plate.

The roller assembly 64 is shown in FIG. 5 as comprising support bar 80, upper arm portion 82, lower arm portion 84, first roller axle 86 and second roller axle 88. The support bar 80 extends generally perpendicularly from the base plate (although other configurations are contemplated). The support bar 80 includes first end 83 and second end 85 as well as upper surface 87 and lower surface 89. The first end 83 is coupled to the foot surface of the base plate opposite the base portion 74 of the mating channel (so as to be generally central to the base plate). In the configuration shown, the first end of the support bar is welded to the foot surface of the base plate. Additionally, in the configuration shown, the support bar comprises a bar of generally square cross-sectional configuration. Of course, other configurations are contemplated.

The upper arm portion 82 extends away from the upper surface 87 of the support bar proximate the second end thereof. In the embodiment shown, the upper arm portion extends generally perpendicular to the support bar and generally parallel to the base plate, and the mating channel, while being in substantially the same plane as the mating channel 62. In the same manner, lower arm portion 84 extends away from the lower surface 89 of the support bar proximate the second end thereof in a direction opposite of the upper arm portion, with the two arm portions being substantial mirror images of each other, and being collinear. While in the embodiment shown, the upper and lower arms and the support bar are integrally formed. In other configurations, they may be separate components, or partially separate components that can be coupled together through adhesion, fastening or welding, for example.

The first roller axle 86 extends generally perpendicular to the upper arm portion at a distal end thereof, in a generally parallel configuration to the foot surface of the base plate. The first roller axle extends generally equally in either direction from the upper arm portion. First pad 90*a* is positioned over the first roller axle to one side of the upper arm portion. The first pad 90*a* comprises a pad of a generally cylindrical configuration with the axle extending through the center of the circular cross-sectional configuration. Similarly second pad 92*a* is positioned over the first roller axle to the opposite side of the upper arm portion, and is a virtually mirror image configuration of the first pad 90*a*. The pads may be mounted on bearings such that they freely rotate (or rotate with some resistance) relative to the first roller axle, while generally being limited (or stopped) from axial movement. The pads extend at least partially toward the side edges of the base plate. In the configuration shown, the pads remain within the footprint of the base plate. In other configurations, shapes other than cylindrical configurations are contemplated.

The second roller axle 88 extends generally perpendicular to the lower arm portion at a distal end thereof, in a generally parallel configuration to the foot surface of the base plate and in a generally parallel configuration to the first roller axle, spaced apart therefrom. The second roller axle extends generally equally in either direction from the lower arm portion. First pad 90*b* is positioned over the second roller axle to one side of the lower arm portion. The first pad 90*b* comprises a pad that is substantially identical to the first pad 90*a*. Second pad 92*b* extends on the opposite side of the lower arm portion and is a substantial mirror image of the first pad 90*b* and is generally identical to and spaced from the second pad 92*a*. As with the pads of the first roller axle, the pads of the second roller axle may be configured to rotate about the second roller axle freely, or with some resistance to rotation. The roller assembly defines a foot receiving region for each of the right and left foot of a user. That is, in the configuration shown, the foot region includes the region between the first and second pads 90*a*, 92*a* for one foot and first and second pads 90*b*, 92*b* for the other foot.

Figure 7:
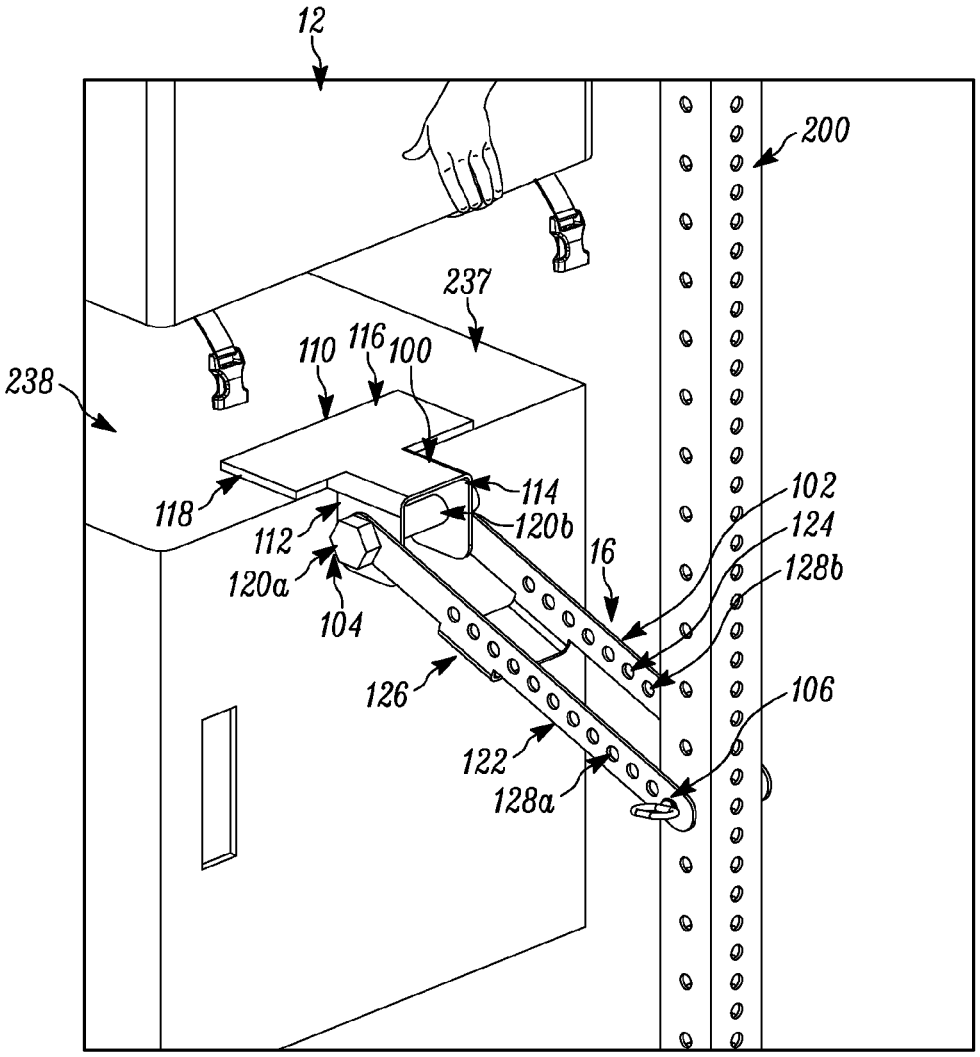
FIG. 7 of the drawings is a partial perspective view of a configuration of the glute ham developer in a system environment, showing, in particular, the stabilizer assembly, and the configuration of the box coupling bracket coupled to the outside box, and the beam portion coupled to the box coupling bracket and to the existing outside support.
Figure 8:
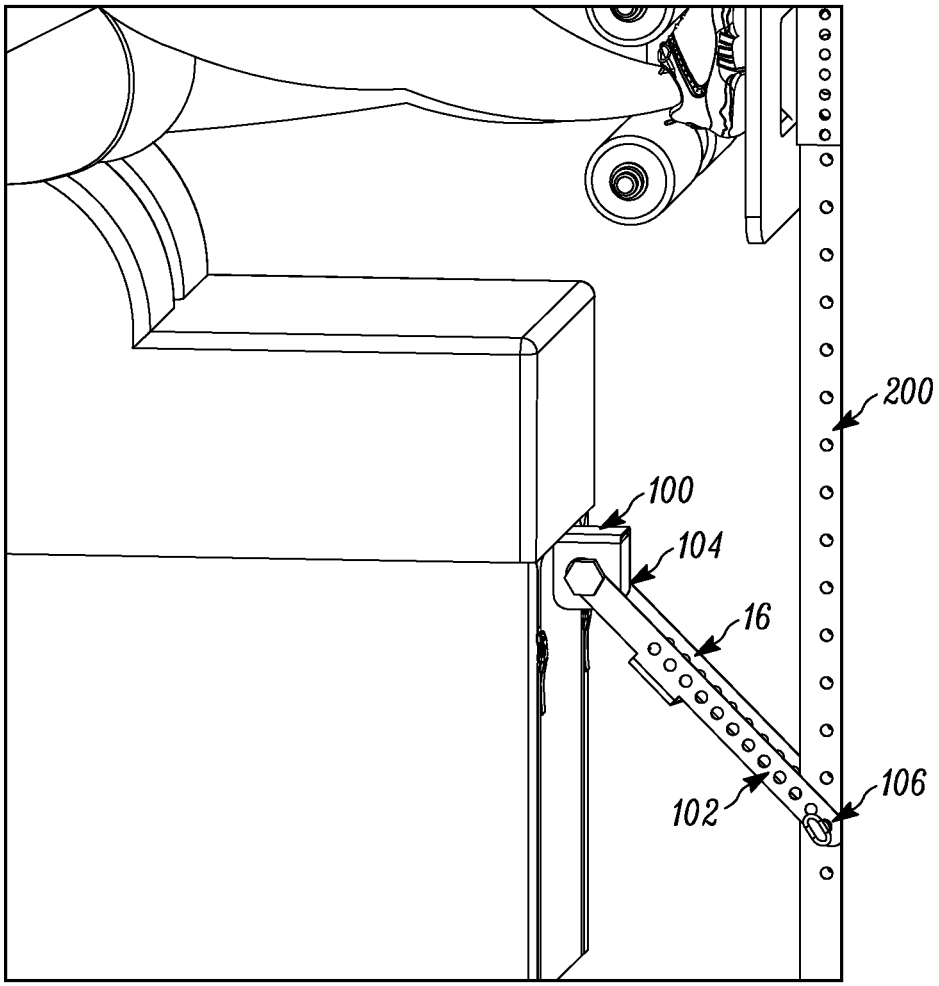
FIG. 8 of the drawings is a partial perspective view of a configuration of the glute ham developer in a system environment, showing, in particular, the stabilizer assembly, and the configuration of the attached pad assembly on the existing box, and the coupling of the stabilizer assembly to the existing outside support.
Figure 9:
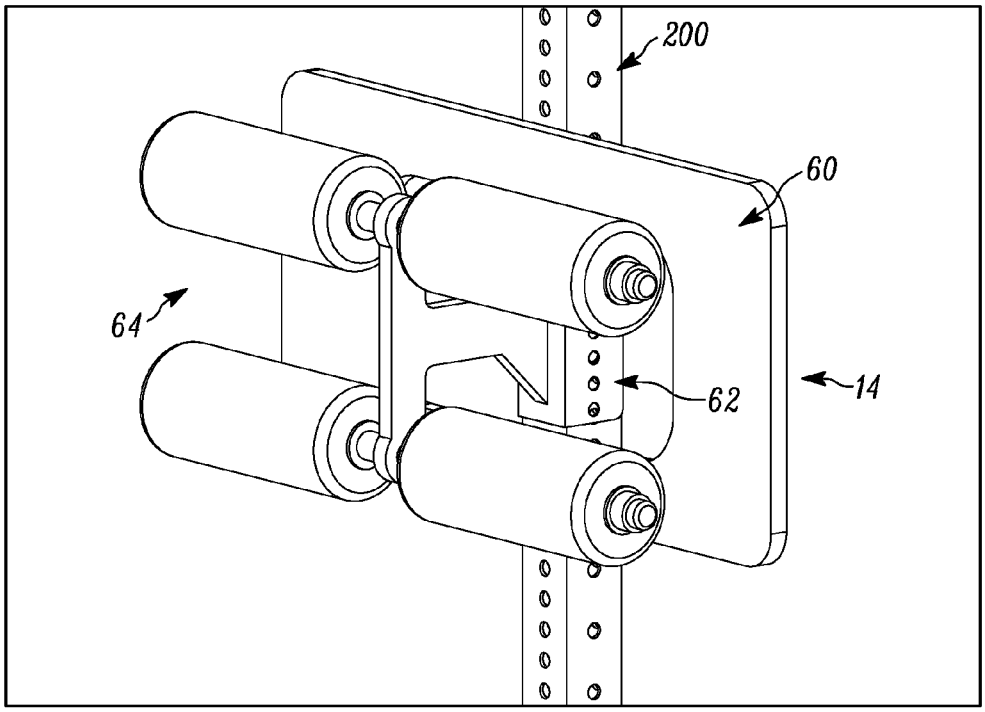
FIG. 9 of the drawings is a partial perspective view of a configuration of the glute ham developer in a system environment, showing, the foot retention assembly coupled to an existing outside support which comprises a c-channel coupled to a wall structure.

The stabilizer assembly 16 is shown in FIGS. 7 and 8 as comprising box coupling bracket 100, beam portion 102, first pivot axle 104 and rack coupling pin 106. The box coupling bracket 100 includes top engaging panel 110, first dependent leg 112 and second dependent leg 114. The top engaging panel 110 is a generally planar member which includes an upper surface 116 and a lower surface 118. As will be explained, the lower surface 118 of the top engaging panel is positionable in a manner so as to overlie the top wall 238 of the existing box in overlying engagement. Fasteners and the like may extend through openings in the top engaging panel so as to extend into the top wall for purposes of coupling. In other configurations, the fasteners are not required and the position is maintained due to the orientation of the top engaging panel and the configuration of the top engaging panel.

The first dependent leg 112 and the second dependent leg 114 depend from the top engaging panel at one end thereof, so as to be substantially perpendicular to the top engaging panel, and spaced apart from each other so that the portion of the top engaging panel and the first and second dependent legs together form a c-channel opening in the direction of the lower surface 118 of the top engaging panel. In the operating configuration, the first and second dependent legs extend along the front wall 230 of the existing box and outwardly therefrom in a manner generally perpendicular to the front wall 230. The upper edge 237 between the top wall and the front wall is captured where the top engaging panel meets the first and second dependent legs.

The first and second dependent legs 112, 114 each include an opening 128*a*, 128*b* which correspond to each other and which are configured to receive a pivot axle therethrough so as to span thereacross.

The beam portion 102 includes first side portion 122, second side portion 124 and cross-brace 126. The first side portion and the second side portion are spaced apart from each other with the cross-brace 126 providing the coupling between the side portions, and the desired relationship therebetween. The components form a general c-channel with the side portions extending beyond the cross-brace on either end thereof. Each of the side portions 122, 124 include a plurality of openings, at least some of which correspond to each other. The cross-brace is positioned in a spaced apart relationship from the ends of the side portions so that the cross-brace generally is separated from the box coupling bracket to minimize interaction therebetween.

The beam portion 102 is coupled to the box coupling bracket 100 by aligning openings of the first side portion 122 and the second side portion 124 with the openings 120*a*, 120*b*, and directing a first pivot axle 104 therethrough. In the configuration shown, the first pivot axle comprises a threaded fastener. Additionally, in the configuration shown, the side portions are on the outboard side of the depending legs 112, 114, although other configurations are contemplated. In the configuration shown, the box coupling bracket and the beam portion freely pivot relative to each other. Generally, the length of the beam portion may be related to the configuration of the existing box 202. In particular, when not in use, if the length of the beam portion is shorter than the height of the existing box, then, when not in use, the beam portion can lie alongside of the front wall of the existing box in a manner generally parallel thereto. Additionally, with the openings 120*a, b* spaced apart from the edge of the dependent legs, the beam portion remains spaced apart from the existing box, thereby limiting damage thereto. In other embodiments, the configuration may be such that the beam portion rests along the front wall in a stowed orientation.

As will be explained in greater detail below, the openings 128*a*, 128*b*, are matched to openings of the existing support 200, with the rack coupling pin 106 extending therethrough so as to matingly engage the same. Depending on the height of the existing box, the spacing between the existing box and the existing support and the configuration of the existing support, a number of openings are provided to allow for adjustability.

To assemble the glute ham developer 10, particular reference is made to FIGS. 1 and 2, along with reference to the remaining figures. FIG. 1 depicts a fully assembled glute ham developer 10 in cooperation with an existing support 200 and an existing box 202. It will be understood that in various configurations, the existing box may be removed, as may be the stabilizer assembly. In other configurations, the user may desire to omit the pad assembly and the stabilizer assembly.

To assemble the full glute ham developer 10 with each of the pad assembly, the foot retention assembly and the stabilizer assembly, the user first determines the existing support 200 to which the glute ham developer will be associated. Among other considerations, the chosen support must be sized so as to be compatible with the stabilizer assembly and the foot retention assembly, and generally includes the desired openings for securement of the same. Additionally, the requisite space is preferably available for the installation. In the same manner, the desired existing box 202 is determined for use. While not required, it is preferred that the existing outside support be bolted to an outside structure, or otherwise coupled thereof. For example, the outside support may be coupled to the ground in the case of a rig or rack, or may be coupled to a wall or the like in the case of a wall mount rack or the use of other brackets like the bracket offered under the trademark The Strip available from Rogue Fitness of Columbus, Ohio.

Once selected, the user can couple the stabilizer assembly to the existing box. In particular, the box coupling bracket 100 is positioned so that the lower surface 118 thereof overlies the top wall 238 of the existing box, with the dependent legs extending downwardly along the front wall 230 of the existing box. Preferably, the box coupling bracket is centered between the first and second side walls 234, 236 of the existing box. Once positioned, the two may be coupled through fasteners or the like (i.e., screws, bolts, hook and loop fasteners, snaps, etc.). In other configuration, no such fastening is necessary and the position is maintained by the coupling bracket on the existing box due to the configuration thereof and the interface with the two walls thereof.

Once the stabilizer assembly is coupled to the existing box, the user can install the pad assembly on the existing box. In particular, the base pad portion 20 is positioned so that the bottom surface 31 overlies the top wall 238 of the existing box. The grip insert portion interfaces with the top wall so that the friction between the two generally precludes movement of the pad assembly relative to the existing box. It will be understood that in the configuration shown, the bottom surface of the base pad portion substantially matches the configuration of the top wall 238 of the box.

Once positioned in the desired orientation, the retention subassembly can be utilized to further secure the two structures together. In particular, the first side straps are extended about the front wall, the back wall and across the bottom. Similarly the second side straps are extended about the front wall, the back wall and across the bottom. The respective clamp portions are joined together. As the straps are adjustable in the configuration shown, the user can tighten the straps to insure a tight and secure fit. In combination with the grip insert portion, such securement generally precludes relative movement of the bottom surface of the base pad portion relative to the top wall of the existing box.

Next, the user can couple the stabilizer assembly to the existing outside support. In particular, the outside box is positioned in the desired orientation relative to the existing outside support. That is, the particular desired spacing between the two is determined (and may be based upon a number of factors, including the configuration of the existing box, the pad assembly, the outside support), and the dimensions of the particular user. Once positioned, the beam portion is rotated about the first pivot axle 104, and directed toward the outside support until the ends thereof interface with the existing outside support. Openings of the first and second side portions are then aligned with openings on the outside support (and in this case, on the side panels thereof). In the configuration shown, the first and second side portions extend on either side of the outside support so as to overlie the side panels thereof. Once aligned, a rack coupling pin can be extended through all of the openings to secure the components together. A number of different pins, or threaded members may be utilized, and the configuration is not limited to any particular configuration. Advantageously, by utilizing pins, adjustment for different users, for example, can be facilitated.

Next, the foot retention assembly can be introduced and coupled to the outside support. In particular, the user determines the height at which the foot retention assembly will be coupled on the existing support (with the understanding that the support that is utilized is typically, although not required to be, the same support to which the stabilizer assembly is coupled). Once the position is determined, the user directs the mating channel 62 of the foot retention assembly so as to surround the outside support. In particular, the base portion of the mating channel coacts with the front panel with the first and second side panels of the mating channel coacting with the respective side panels of the outside support. It is preferred that the mating channel is closely matched with the existing support dimensionally so as to preclude relative movement upon installation. Once coupled, the foot retention assembly can be moved relative to the outside support so that the openings 76*a*, 76*b* of the mating channel interface with corresponding openings of the outside support. Upon aligning the openings, a pin or other fastener member can be extended therethrough so as to mate the structures together.

It will be understood that multiple openings may be lined up so that multiple pins or fasteners can be extended therethrough so as to limit the movement of the two structures relative to each other. The position of the openings can be varied depending on the configuration of the mating structures. In other embodiments, the base portion may include openings as well, or in place of the other openings. In such a configuration, a pin member or other fastener may be extended through the base portion and through the outside support by way of the front panel 224. In still other configurations, pins may be presented on either one of the base portion or on the outside support which interface with openings on the other of the two structures. In such a configuration, the pins are mated with the openings. The pins and the openings may have configurations which allow for locking of the structures together (i.e., pins with heads, and openings with areas of reduced dimension capable of capturing the pin between the base and the head). It will be further understood that by providing multiple openings on the mating channel, and/or the existing outside support, the adjustability of the two components can be enhanced, so as to offer a desired position for a number of different configurations of the equipment and for different dimensioned users.

Figure 10:
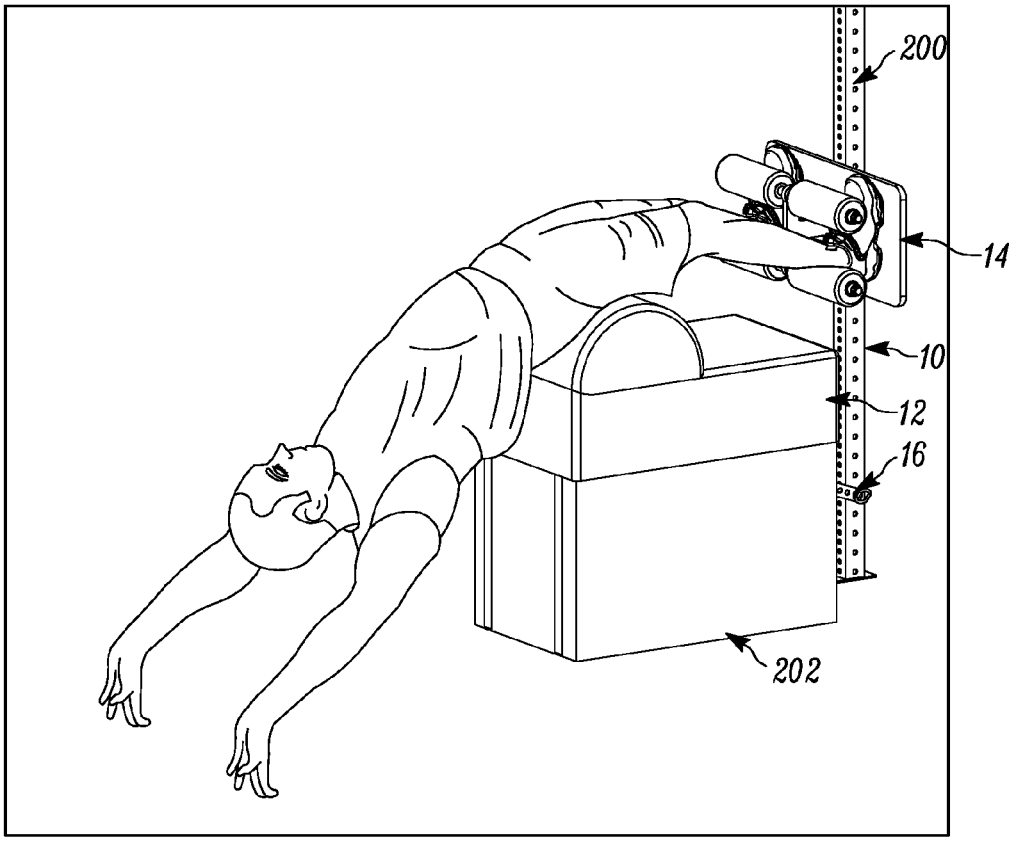
FIGS. 10 and 11 are partial perspective views of the configuration of the glute ham developer in a system environment, showing, in particular, a user in various stages of a typical exercise performed on the glute ham developer.
Figure 11:
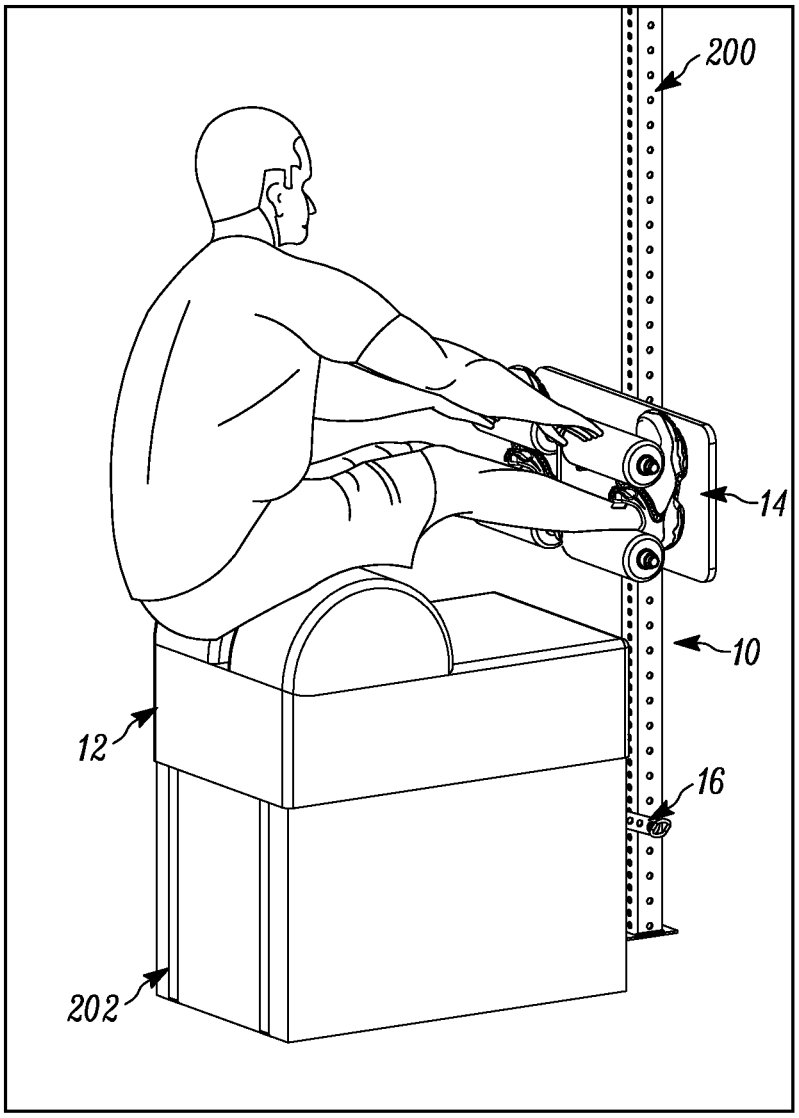

Once assembled, the user can operate the device. The operation of conventional glute ham developers is known in the art. The present glute ham developer allows the user to utilize the system in the conventional manner. In particular, the user can insert the foot into the foot retention assembly so that the ankle and the lower leg exits between the first and second pad on either side of the support bar. The user can place the buttocks on or near the raised pad portion and then undertake sit-up like movements. In other configurations, the knees of the user can be positioned proximate the raised pad portions and with the legs in the foot retention assembly pointed in a downward direction. Such a use is shown in FIGS. 10 and 11. There are additional manners of use of a glute ham developer.

When the user has completed use of the glute ham developer, and wishes to stow the device (or to utilize some of the components, such as the existing box), the user can remove the rack coupling pin coupling the stabilizer assembly to the outside support. The user can then reposition the existing box as desired. Removal of the pad assembly can be achieved by merely undoing the clasp members and removing the side straps from extending around the existing box. The pad assembly can then be removed from the existing box. Once the pad assembly has been removed, access to the top engaging panel of the box coupling bracket is revealed. The user can remove the stabilizer assembly, or, alternatively, can allow the stabilizer assembly to remain in position with the beam portion extending along the front wall.

It will be understood that the foot retention assembly can be removed from the rig, rack or other outside support. Alternatively, if the foot retention assembly is not in the way of other activities, the foot retention assembly can remain in position so that reassembly merely involves the reassembly of the pad assembly on the existing box, and, optionally the stabilizer assembly.

It will further be understood that the different components have individual utility. For example, the foot retention assembly can be utilized without any other components to retain the foot/leg of a user (i.e., it may be positioned very low on an outside support, with the user sitting on the ground). The pad assembly can be utilized without the foot retention assembly, or without the existing box as desired. For example, the foot retention assembly can be moved relatively low on an outside support, and the pad assembly can be placed on the ground. The stabilizer assembly can be utilized to maintain a position of a box without the use of the pad assembly or the foot retention assembly. Alternatively, the stabilizer assembly can be removed, with the user relying on other means of maintaining the box in position (friction, other mounting, etc.).

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A glute ham developer comprising:

a pad assembly including a base pad portion and a retention sub-assembly, the retention sub-assembly configured to couple the base pad portion to an existing box;

a foot retention assembly including a base plate having a foot surface and a support surface, a mating channel extending from the support surface of the base plate, the mating channel configured to be releasably coupled to an existing outside support spaced apart from the existing box, a roller assembly extending from the foot surface of the base plate, the roller assembly having a pair of roller axles in a spaced apart orientation relative to each other defining a foot receiving region therebetween; and a stabilizer assembly having a first end configured to be coupled to the existing box and a second end configured to be attachable to the existing outside support, wherein the stabilizer assembly further includes a box coupling bracket configured to be coupled to the existing box, and a beam portion, the beam portion being pivotably coupled to the box coupling bracket about a first pivot axle, with the beam portion configured to be selectively attachable to the existing outside support.

2. The glute ham developer of claim 1 wherein the box coupling bracket further includes a top engaging panel configured to be positionable to overlie a top wall of the existing box, a first and second dependent leg extending from the top engaging panel and configured to extend across a front wall of the existing box, the first and second dependent legs having a corresponding opening to receive the first pivot axle; and wherein the beam portion includes a first side portion interfaceable with the first dependent leg, and a second side portion interfaceable with the second dependent leg, each of the side portions having a pivot opening to receive the first pivot axle, to, in turn, allow for the beam portion to pivot about the first pivot axle relative to the box coupling bracket.

3. The glute ham developer of claim 2 wherein the first side portion and the second side portion each further includes corresponding openings spaced apart from the respective pivot opening, the corresponding openings configured to receive a rack coupling pin through each of the first side portion and the second side portion, and structurally configured to receive the existing outside support therebetween.

4. The glute ham developer of claim 3 wherein the first side portion and the second side portion together include a plurality of pairs of corresponding openings to, in turn, provide a plurality of receiving openings for the rack coupling pin.

5. The glute ham developer of claim 4 wherein the beam portion further includes a cross brace that extends between the first side portion and the second side portion thereby coupling the first and second side portions.

6. The glute ham developer of claim 1 wherein the pad assembly further comprises the base pad portion that has a bottom surface and a top surface, the bottom surface having a grip insert portion formed from a material of high friction.

7. The glute ham developer of claim 1 wherein the pad assembly further comprises the base pad portion having a top surface, and a raised pad portion, the raised pad portion extending from the top surface of the base pad portion, and having an outwardly convex configuration.

8. The glute ham developer of claim 7 wherein the raised pad portion includes a first portion and a second portion spaced apart from the first portion, wherein the first and second portions are mirror images of each other taken about an axis midway between opposing side edges of the base pad portion.

9. The glute ham developer of claim 1 wherein the retention sub-assembly further comprises at least one side strap that is configurable to extend about the existing box, and configured to releasably secure the same to the existing box.

10. The glute ham developer of claim 9 wherein the at least one side strap further comprises at least two side straps positioned in a side by side spaced apart configuration.

11. The glute ham developer of claim 10 wherein the at least two side straps extend from a front of the pad assembly and are then configured to extend around a front wall, a bottom and a back wall of the existing box, extending then to a back of the pad assembly.

12. The glute ham developer of claim 11 wherein each of the at least two side straps include a length, and the length of each of the at least two side straps is adjustable.

13. The glute ham developer of claim 11 wherein each of the at least two side straps includes a first member and a second member, with the first and second members being coupled through a clasp portion.

14. The glute ham developer of claim 1 wherein the mating channel further includes a first side panel and a second side panel, the first and second side panels including at least one set of corresponding openings, configured to be alignable with openings on the existing outside support, and a coupling member configured to be extendable through the openings on the existing outside support and the at least one set of corresponding openings, to releasably couple the same.

15. The glute ham developer of claim 14 wherein the first and second side panels each include a plurality of sets of corresponding openings.

16. The glute ham developer of claim 14 wherein the mating channel is formed from a bent portion of the base plate, to, in turn, define a pair of openings in the base plate on either side of the mating channel.

17. A system having a glute ham developer, the system comprising:

a box, the box having a top surface, a front wall, a bottom and a back wall, the box configured for placement on a ground surface;

a pad assembly having a bottom surface which is positionable on the top surface of the box so as to overlie the same, with a retention assembly comprising at least two side straps extending from a front of the pad assembly, around the front wall of the box, across the bottom of the box, and along the back wall of the box, and extending then to a back of the pad assembly;

a support in the form of a vertical beam configured to be coupled to one of the ground surface and a wall, the vertical beam being spaced apart from the box, with the front wall of the box facing the vertical beam;

a foot retention assembly having a base plate and a roller assembly extending from the base plate, the roller assembly configured to releasably retain the feet of a user, the foot retention assembly further having a mating channel defined by a first side panel and a second side panel spaced apart from each other and substantially parallel to each other, the mating channel releasably positionable over at least a portion of the vertical beam between a lower and an upper end thereof;

wherein the box is positioned on the ground surface spaced apart from the vertical beam; and a stabilizer assembly including a first end coupled to the box, and a second end coupled to the vertical beam, with the stabilizer assembly further comprising a beam box coupling bracket coupled to the box, and a beam portion pivotably coupled to the box coupling bracket, and attachable to the vertical beam.

18. A method of assembling a glute ham developer comprising the steps of:

providing a pad assembly;

positioning the pad assembly on a top surface of a box;

releasably retaining the pad assembly on the top surface of the box by extending at least two straps that extend around a front wall, a bottom and a back wall of the box;

providing a foot retention assembly, the foot retention assembly having a mating channel extending from a support surface of a base plate, the mating channel formed by a first side panel and a second side panel spaced apart from the first side panel and substantially parallel thereto, the first side panel and the second side panel together having a plurality of pairs of corresponding openings;

extending the mating channel over a portion of a vertical beam, with the vertical beam having a plurality of openings extending therethrough;

aligning at least one of the plurality of pairs of corresponding openings of the mating channel with the openings of the vertical beam;

extending a rack coupling pin through the aligned openings of the mating channel and the vertical beam so as to releasably secure the foot retention assembly to the vertical beam;

providing a stabilizer assembly, the stabilizer assembly having a box coupling bracket and a beam portion pivotably coupled thereto, the beam portion having at least one pair of corresponding openings;

coupling the box coupling bracket of the stabilizer assembly to one of the top surface and the front wall of the box; and aligning the at least one pair of corresponding openings of the beam portion with corresponding openings of the vertical beam and extending a second rack coupling pin therethrough, to, in turn, couple the beam portion of the stabilizer assembly to the vertical beam.

19. A system having a glute ham developer, the system comprising:

a box, the box having a top surface, a front wall, a bottom and a back wall, the box configured for placement on a ground surface;

a pad assembly having a bottom surface which is positionable on the top surface of the box so as to overlie the same, with a retention assembly comprising at least two side straps extending from a front of the pad assembly, around the front wall of the box, across the bottom of the box, and along the back wall of the box, and extending then to a back of the pad assembly;

a support in the form of a vertical beam configured to be coupled to one of the ground surface and a wall, the vertical beam being spaced apart from the box, with the front wall of the box facing the vertical beam;

a foot retention assembly having a base plate and a roller assembly extending from the base plate, the roller assembly configured to releasably retain the feet of a user, the foot retention assembly further having a mating channel defined by a first side panel and a second side panel spaced apart from each other and substantially parallel to each other, the mating channel releasably positionable over at least a portion of the vertical beam between a lower and an upper end thereof;

wherein the existing box is positioned on the ground surface spaced apart from the vertical beam; and wherein the first side panel and the second side panel together include a plurality of pairs of corresponding openings, and wherein the vertical beam further includes openings extending therethrough that are placeable in correspondence with the plurality of pairs of corresponding openings of the first side panel and the second side panel such that a rack coupling pin of the system may be inserted therethrough to releasably couple the foot retention assembly to the vertical beam, and to substantially preclude relative movement therebetween.

20. The system of claim 19 wherein the first side panel and the second side panel of the mating channel are integrally formed with the base plate, and are bent relative to the base plate so as to be substantially perpendicular thereto.

* * * * *